United States Patent [19]

Symonds et al.

[11] Patent Number: 4,796,939

[45] Date of Patent: Jan. 10, 1989

[54] LIFTING MEANS

[75] Inventors: Darrell Symonds, Perth, Australia; Kenneth R. King; William N. Smith, both of Savannah, Ga.

[73] Assignee: CorSling, Inc., Savannah, Ga.

[21] Appl. No.: 21,882

[22] Filed: Mar. 4, 1987

[51] Int. Cl.[4] ..... B65H 49/00; B66C 1/16

[52] U.S. Cl. ..... 294/67.1; 242/129; 294/158

[58] Field of Search ..... 294/1.1, 67.1, 67.3, 294/67.4, 67.41, 86.24, 74, 89, 93–97, 158; 206/303, 386, 595; 242/68, 68.3, 68.6, 79, 85, 85.1, 129, 129.5, 136; 414/684, 910, 911

[56] References Cited

U.S. PATENT DOCUMENTS

| | | | |
|---|---|---|---|
| 181,244 | 8/1876 | Campbell . | |
| 186,956 | 2/1877 | Rogers . | |
| 1,510,564 | 10/1924 | Stockfleth et al. | 294/67.1 X |
| 2,752,191 | 6/1956 | Pierce . | |
| 3,289,666 | 12/1966 | Prather . | |
| 3,301,451 | 1/1967 | Halverson | 294/158 |
| 3,626,508 | 12/1971 | Sharrow | 294/89 |
| 3,768,852 | 10/1973 | Back et al. | 294/1.1 X |
| 3,778,002 | 12/1973 | Alleweireldt | 242/129 |
| 4,085,875 | 4/1978 | Campbell et al. | 294/158 |
| 4,345,788 | 8/1982 | Newton | 294/67.1 X |
| 4,591,200 | 5/1986 | Randen | 294/89 X |

FOREIGN PATENT DOCUMENTS

| | | | |
|---|---|---|---|
| 1174459 | 7/1964 | Fed. Rep. of Germany | 294/158 |
| 281586 | 5/1964 | Netherlands | 294/67.1 |
| 173693 | 1/1922 | United Kingdom . | |
| 795896 | 6/1958 | United Kingdom . | |

*Primary Examiner*—Johnny D. Cherry

*Attorney, Agent, or Firm*—Cushman, Darby & Cushman

[57] ABSTRACT

An assembly for effecting the lifting of a paper roll wherein the roll includes a hollow axial core, the assembly including a support designed to interlock with the core at one end thereof and a lifting sling engaging, at one end, the support and extending therefrom through the hollow core of the paper roll so that it will protrude from the other end of the core.

10 Claims, 4 Drawing Sheets

LIFTING MEANS

FIELD OF THE INVENTION

Figure 1:
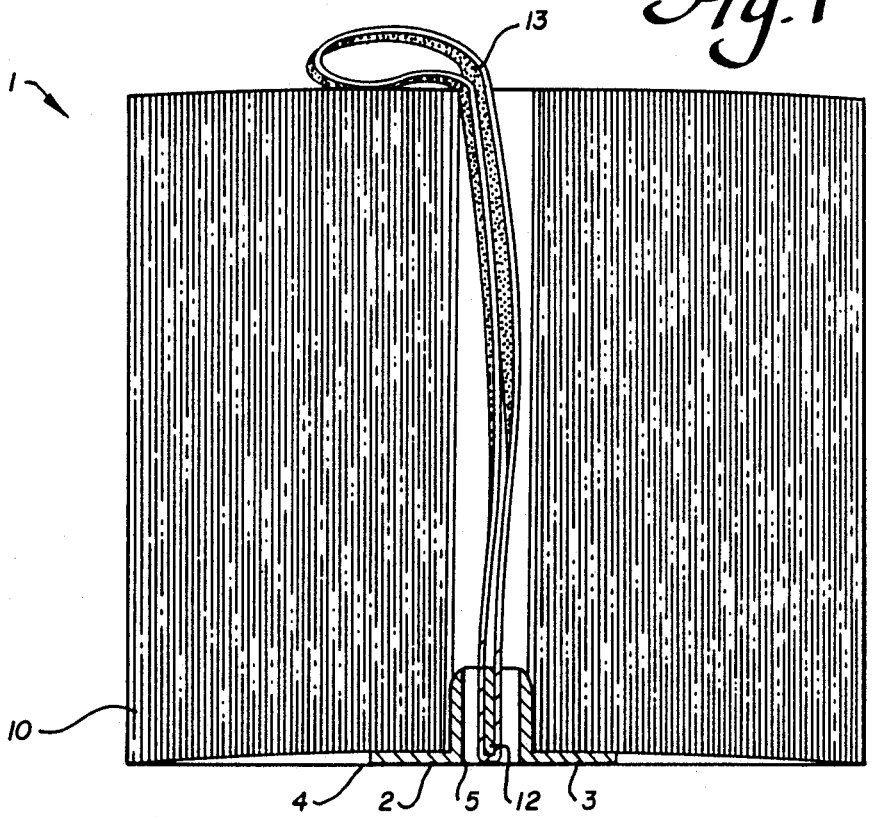

The present invention relates to a lifting device for industrial paper rolls.

BACKGROUND OF THE INVENTION

In the shipping industry, there are now in use many methods and devices for loading and unloading industrial rolls of paper ranging in weight from 800 lbs. to 3,500 lbs.

The methods and devices now in use are as follows:

1. Standing the paper rolls on end and lifting them with mechanical head clamps;
2. Banding the rolls together in pairs and placing four at a time on metal platforms, which are lifted with slings;
3. A forklift with hydraulic side clamps (instead of a fork) grabs the paper rolls and stacks them onto the platforms;
4. Laying the rolls flat over circular web slings, then tightening the sling around the roll to be lifted by crane;
5. Placing the rols on end on top of a square rigged web sling, then pulling the four corners of the sling up over the top of the roll to be lifted by crane; and,
6. Inserting a vacuum probe into the core of the sling, then expanding said probe by blowing air into it by hydraulic means, then lifting the roll by its end with a crane.

The problem to which this invention is directed is that most of the methods presently used can either result in substantial damage to the paper rolls (damage running as high as 27% of all paper shift) or the method results in relatively slow handling with significant labour required which therefore makes such handling methods expensive.

An object of the present invention is to provide for lifting and loading of paper rolls which will reduce the potential for damage and at the same time provide for reduced need for labour-intensive handling and assist in providing for quicker handling.

The invention can be said to reside in an assembly for effecting a lifting of the paper roll wherein the roll includes a hollow axial core, the assembly including support means interlocking with the core at a first end of the core, and a lifting sling engaging, at one end, the support means and extending therefrom through the hollow core to protude from the other end of the core.

In preference, the support means are comprised of a first part extending across and beyond that part which is hollow of the first end of the roll and a second part within the hollow core engaging the inner wall and providing for centering support of the sling thereby.

By having the sling pass effectively through the full depth of a hollow core of a paper roll enables the sling to be held by a relatively simple and therefore economic arrangement at the bottom end where the shape of the hollow core terminates providing a lowermost abutting bottom face.

A further problem, however, is that slings appropriate for the application are best obtainable as a continuous loop.

In a preferred arrangement then, there is proposed that these support means are comprised of at least two separable parts, one of which is a sling interlock part which can be separately positioned through the sling and thereafter interlock with the support means and therefore the sling.

In a further preferred arrangement, the second part is comprised of two members each cut and formed from a plate-like shape of the first part.

In preference, the two members are of substantially the same size and shape and are located so as to provide engaging support for the sling.

The invention in a further form can be said to reside in paper roll lifting means including support means adapted by reason of shape and size to interlock with one end of a core of a paper roll, and a lifting sling comprised of an endless strap, engaging, at one end the support means and being adapted by reason of its length to extend through the hollow core of the paper roll.

Figure 2:
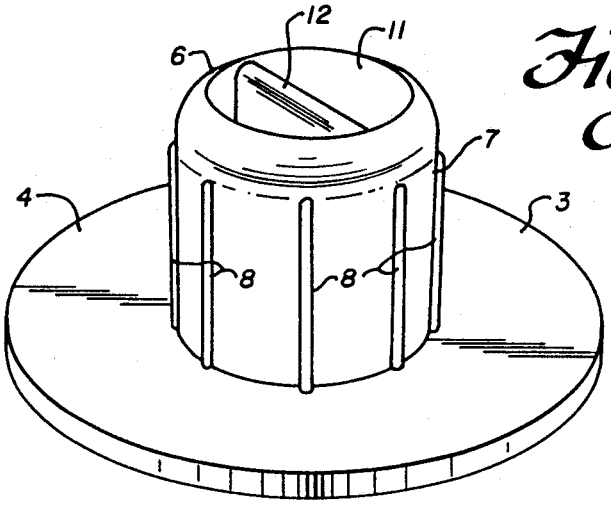
Figure 3:
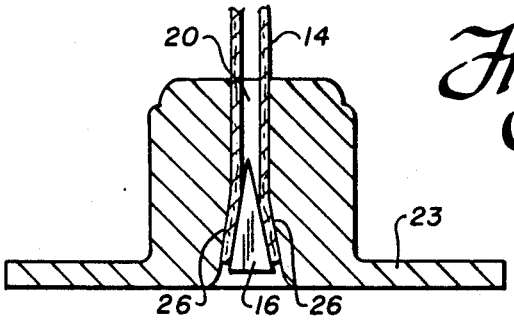
Figure 4:
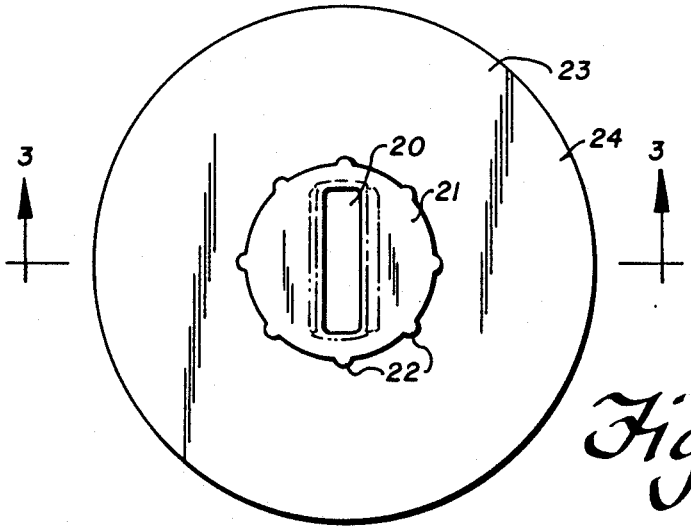
Figure 5:
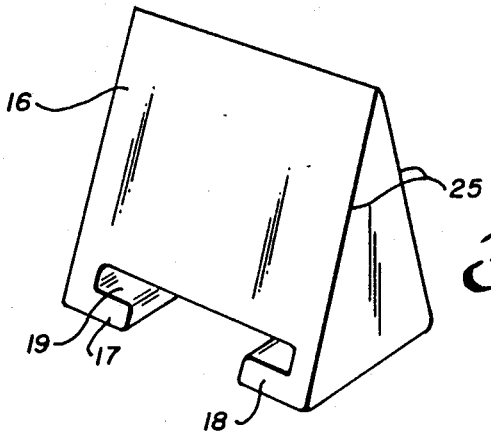
Figure 6:
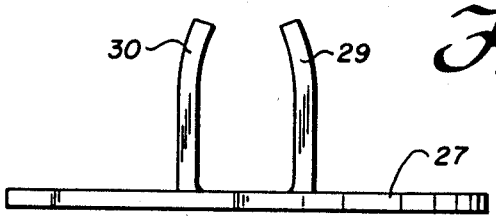
Figure 7:
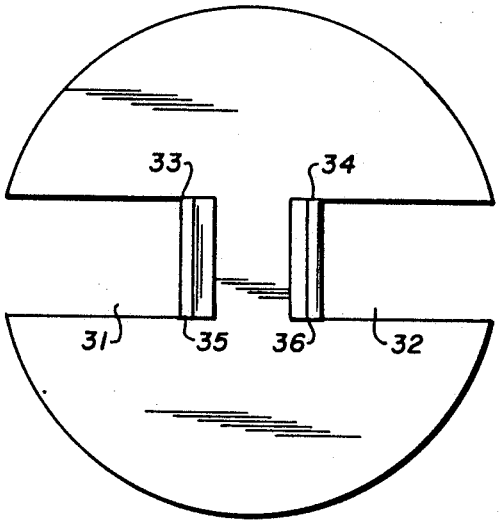
Figure 8:
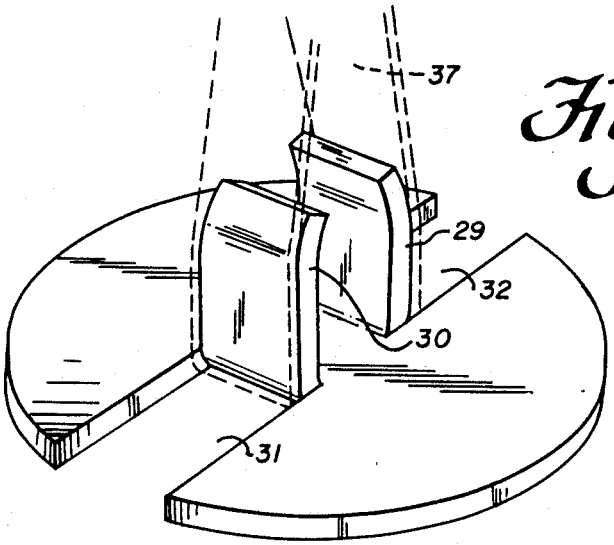
Figure 9:
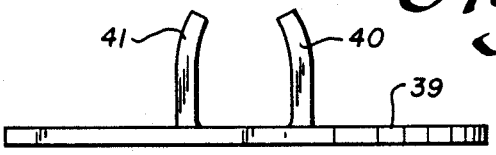
Figure 10:
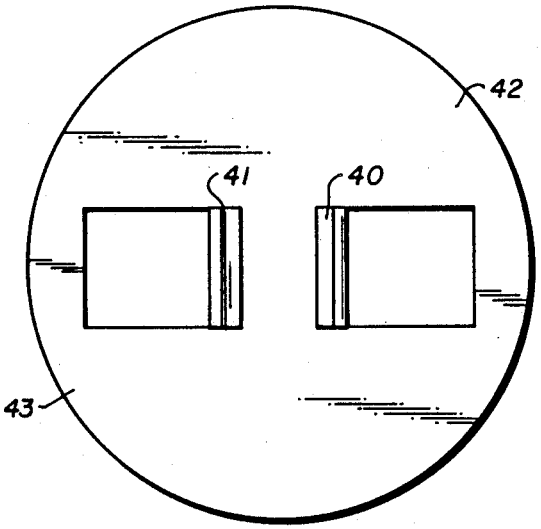
Figure 11:
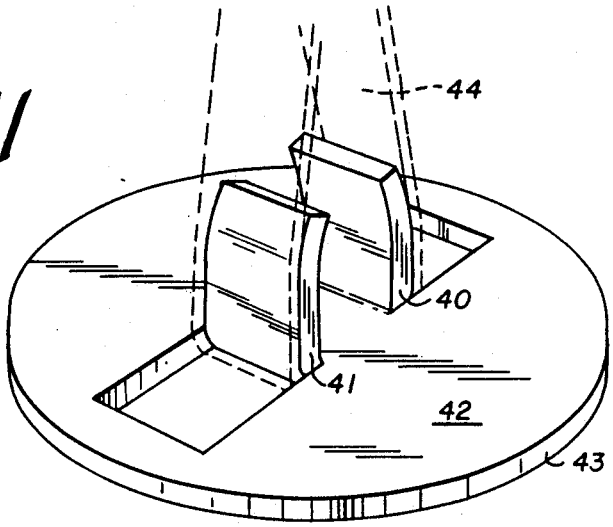

Other features and advantages of the invention will be further appreciated by reference to the preferred embodiments which shall now be described with the assistance of drawings, in which:

FIG. 1 is a cross-sectional view of an assembly according to the first preferred embodiment illustrating a paper roll with support means at a bottom end of the hollow core of the paper roll, and a sling interlocking with this, FIG. 2 is an external view of the support means as shown in FIG. 1, FIG. 3 is a cross-sectional view of a part of an assembly according to a second embodiment, FIG. 4 is a plan view of a part of the support means as shown in FIG. 3, again according to the second embodiment, and FIG. 5 is a perspective view of the sling interlock part shown in FIG. 3 in side view, FIG. 6 is a side elevation of the third embodiment, FIG. 7 is a plan view of the same embodiment as shown in FIG. 6, FIG. 8 is a perspective view of the embodiment as shown in FIGS. 6 and 7 showing in dotted outline the path of a strap that might be used in conjunction with the support means, FIG. 9 is a side elevation of a fourth embodiment, FIG. 10 is a plan view of the embodiment as shown in FIG. 9, and FIG. 11 is a perspective view of the embodiment as shown in FIGS. 9 and 10 showing in dotted outline the path of a strap that might be expected to be used in conjunction with this article.

Referring to the drawings in detail, an assembly 1 is comprised of support means 2 which include a first part 3 which is comprised of an annular part having an outer circular periphery 4 and an inner circular periphery at 5.

Integral with this first part is a second part 6 which is comprised of a part of cylindrical shape having an external cylindrically shaped surface at 7 with a plurality of uniformly spaced apart ridges 8 around the cylindrical shape 7.

The cylindrical shape is modified at an upper end by having an inwardly inclined surface to provide for ready location and input into the hollow core 9 of the roll 10.

Within the cylindrical shape of the part 6 is an inner cylindrical aperture 11 which has a diametrically aligned web 12 which extends just above a plane defined by the bottom face of the plate part 4 to allow for sufficient clearance to allow a strap 13 to engage around a bottom of this web 12.

The strap 13 constitutes a sling made from braided nylon and is either manufactured or joined as appropriate to form an endless loop, one end of which therefore engages around the web 12 and the other end of which protrudes from the other end of the hollow core 9 of the roll 10.

In use, the support means 2 with the strap 13 is located into a paper roll such as that at 10 and the strap is fully threaded through the hollow core with the uppermost end then available for appropriate support purposes.

The diameter of the cylindrical surface 7 and the size and location and shape of the ridges 8 are selected so as to be appropriate for the conventional size of a hollow core of a paper roll and are in fact such that the ridges will just bite into the inner surface of the material defining the hollow core 9.

In this way, the support means 2 anchors inself in position and also ensures that the cylindrical shape of the part 6 will stay coaxial with the hollow core 9.

The sides of the web 12 will be also kept parallel to the axial direction of the inner cylindrical aperture 11 so that when the strap 13 is supported thereover, as shown in FIG. 1, a lining effect will maintain the condition of roll 10 essentially vertical when roll 10 is being supported.

Further, however, the selection of the diameter of the annular shape and especially the external perimeter of the part 3 at 4 is chosen so that there will be enough support to provide adequate bearing support for the strap 13 but it is also found that the outer edges of the roll will have a tendency to droop slightly but this is found to not be consequential and by selection of a sutiably small thickness of plate, there is sufficient droop so that rolls when located one above the other will locate without a perimeter against outer perimeter to an extent providing for stability.

It is to be noted that the drawing is self evidently schematic at least insofar as its representation of the paper roll is concerned and is intended to illustrate the concept and the application of this to those who are familiar with the conventional paper roll.

In FIGS. 3, 4 and 5, there is shown the second embodiment, significant difference between this and the first being the manner in which the sling 14 in the form of an endless strap, is secured to support means 15.

This interlocking is achieved by using a sling interlock part 16 which is in the form of a wedge having lowermost inwardly turned legs 17 and 18.

In this way the strap shape will pass through the slot at 19 thereby mutually holding the wedge shape with the bottom most loop shape of the strap 14.

Matching with this there is a slot 20 passing fully through from top to bottom a cylindrical plug part 21, the external diameter of which is intended to be coaxially aligned with the hollow core of a paper roll which includes eight parallel ridges 22 which are intended to project sufficiently to bite and therefore grip the wall defining one end of such hollow core of a paper roll.

A cylindrical plug part 21 is stopped from passing through the hollow core of a paper roll by the transverse plate part 23 which has an outer cylindrical perimeter at 24, the diameter of which is chosen together with the thickness of the plate to provide sufficient support, especially when the sling 14 constituted by a strap is used to lift the full weight of a paper roll.

The sling interlock part 16 has side walls 25, the relative angle of which as shown in the illustrations matches that of the lower part of slot 20 at walls 26.

The advantage of this arrangement is that the sling in the form of an endless loop can be secured to the support means by simply locating the part 16 with the inturned legs around the edges of the strap and then threading the strap through the slot in the support means.

Further, the self imposed pressure of the wedge shape against the belt material will act to distribute the engaging pressure between the parts so that the strap may be expected to support heavier loads than would be the case with other methods of holding the strap.

Referring now to the third embodiment as shown in FIGS. 6, 7 and 8, there is shown a first part 27 which is of plate-like shape and which has an outermost circular periphery at 28.

The second part is comprised of two separate members in the form of tongues 29 and 30 each of which is of the same size and shape and each of which has been formed by cutting and bending from a preliminary flat or planar shape of the first part 27 leaving thereby slots 31 and 32.

The upper ends of the respective tongues 29 and 30 are inwardly curved so as to assist introduction of these parts into the hollow end of the roll of paper, but the four corners at 33, 34, 35 and 36 are positioned so that they will each ensnare the inner wall surface of the hollow core of a paper roll and hence ensure an interlocking therewith.

The article as such is made from a material that can in fact be formed from cutting and pressing such as sheet steel.

Especially as shown in FIG. 8, the width of the respective tongues 29 and 30, and of course the slots 31 and 32, are such that a strap as shown in dotted outline at 37 can pass appropriately therearound and thereby provide the lifting interlock required for the purpose.

It will be noted that this does not therefore require any modification of the support means so as to provide the location of the strap 37 especially if this is in the form of an endless loop.

This can at times, however, be a disadvantage in that the strap can be lost or not be appropriate for the particular strength of the support means and accordingly in the fourth embodiment described in FIGS. 9, 10 and 11. This fourth embodiment also includes a support plate 42 having a continuous outer periphery 43. The tongues or members 40 and 41 are similar in size and shape, essentially a mirror image of one another, and together with the interconnecting portion of plate 42, as shown in FIG. 11, provide support for a strap 44. The support means 39 have members in the form of tongues 40 and 41 which are pressed from a plate-like first part 42 but such that in use, the support means are inserted into the hollow end of a selected paper roll of the type being discussed with the strap providing a sling passing fully through from the first end through to the other end of the paper roll.

A ship's crane can then drop a hook through the loop of the sling extending from the paper core and lift the paper roll with the support means tightly embedded at the lowermost end of the hollow core, with the weight of the paper roll then resting on the circular flange.

There is thus provided quick and easy means for lifting a paper roll which will have the result of minimal damaging forces being applied to the paper within the roll.

With the use of a spreader bar containing up to 20 bars and hooks, as many as 20 rolls of paper at one time can be safely and economically loaded and unloaded on any transport medium.

We claim:

1. An assembly for effecting the lifting of a roll of paper having a hollow interim core, a plurality of wrapped layers and a bottom face, said assembly including a support device provided at one end of said hollow core and a flexible lifting sling attached to said support device and extending through said hollow core so as to protrude from the opposite end of said hollow core, said support device including a horizontally extending support plate having substantially flat top and bottom surfaces, an upwardly extending member centrally positioned on said support plate and being integrally formed therewith, said upwardly extending member including means defining a hollow interior extending therethrough a web member positioned within said hollow interior and extending across the full interior dimension thereof for engaging said sling and having a bottom surface spaced a predetermined distance inwardly from the bottom of said device, said support plate extending outwardly beyond said upwardly extending member so that it will extend radially beyond said hollow core and engage the bottom face of the paper roll and a plurality of but less than all of the wrapped layers forming the paper roll.

2. An assembly as in claim 1 wherein the bottom surface of said web member extends substantially parallel to the plane defined by said support plate.

3. An assembly as in claim 1 wherein said plurality extending member includes an outer surface and a plurality of spaced apart ribs extending outwardly from and axially along said outer surface.

4. An assembly for effecting the lifting of a roll of paper having a hollow interim core, a plurality of wrapped layers and a bottom face, said assembly including a support device provided at one end of said hollow core and a flexible lifting sling attached to said support device and extending through said hollow core so as to protrude from the opposite end of said hollow core, said support device including a horizontally extending support plate having substantially flat top and bottom surfaces, an upwardly extending member centrally positioned on said support plate and being integrally formed therewith, said upwardly extending member being formed from a pair of members comprising portions of said support plate so that openings corresponding to the shape of each of said pair of members are provided within said support plate and through which said sling extends so as to extend around said upwardly extending member, said support plate extending outwardly beyond said upwardly extending member so that it will extend radially beyond said hollow core and engage the bottom face of the paper roll and a plurality of but less than all of the wrapped layers forming the paper roll.

5. An assembly as in claim 4 wherein said openings extend radially across a predetermined portion of said support plate.

6. An assembly as in claim 4 wherein said openings extend radially to the outer periphery of said support plate.

7. An assembly as in claim 4 wherein said pair of members are spaced equidistantly form the center of said support plate.

8. An assembly as in claim 4 wherein said pair of members each include on outer surface that will engage said sling and wherein said outer surfaces provide laterally straight support surfaces for said sling.

9. An assembly for effecting the lifting of a roll of paper having a hollow interim core, a plurality of wrapped layers and a bottom face, said assembly including a support device provided at one end of said hollow core and a flexible lifting sling attached to said support device and extending through said hollow core so as to protrude from the opposite end of said hollow core, said support device including a horizontally extending support plate having substantially flat top and bottom surfaces, an upwardly extending member centrally positioned on said support plate and being integrally formed therewith, said upwardly extending member including means defining a hollow interior extending therethrough, said hollow interior having lower and upper portions, said lower portion defined by side and end walls with at least said side walls being angled inwardly towards the upper portion, said assembly further including a wedged member having exterior side and end surfaces complimentary to the side and end walls in said lower portion so that said sling can be retained between the complimentary side walls and side surfaces, said support plate extending outwardly beyond said upwardly extending member so that it will extend radially beyond said hollow core and engage the bottom face of the paper roll and a plurality of but less than all of the wrapped layers forming the paper roll.

10. An assembly as in claim 9 wherein said wedge member includes a bottom area and means defining a channel in said bottom area.

* * * * *